United States Patent [19]

Howorth

[11] 4,015,390

[45] Apr. 5, 1977

[54] GLAZING STRUCTURES

[75] Inventor: Ronald Howorth, Littleborough, England

[73] Assignee: BTR Industries Limited, England

[22] Filed: May 25, 1976

[21] Appl. No.: 689,848

[30] Foreign Application Priority Data

Oct. 29, 1975 United Kingdom ..... 44674/75

[52] U.S. Cl. ..... 52/495; 52/235; 52/459

[51] Int. Cl.[2] ..... E04B 1/00

[58] Field of Search .... 52/495, 235, 312, 459–472, 52/716

[56] References Cited

UNITED STATES PATENTS

| | | | |
|---|---|---|---|
| 3,052,330 | 9/1962 | Hammitt et al. | 52/495 X |
| 3,109,206 | 11/1963 | Beam | 52/471 X |
| 3,248,840 | 5/1966 | Petterson | 52/495 X |
| 3,443,350 | 5/1969 | Birum | 52/495 |
| 3,594,028 | 7/1971 | Scott | 52/471 X |

*Primary Examiner*—J. Karl Bell
*Attorney, Agent, or Firm*—Watson, Cole, Grindle & Watson

[57] ABSTRACT

A glazing structure for example for curtain walls for buildings comprises a panel held in position between a structural member and a glazing bead of open channel section and a pair of elastomeric gaskets for making a weathertight seal. The glazing bead is designed to engage the structural member and has side walls which are turned outwardly from one another at their end portions. One end porton of each elastomeric gasket fits between the respective outwardly turned end portions of the glazing bead and the panel and the other end portion fits in the open channel of the glazing bead. In this way the external surface of the structural member and the glazing bead are covered by the elastomeric gasket to provide a maintenance free exterior for a building.

3 Claims, 4 Drawing Figures

GLAZING STRUCTURES

BACKGROUND TO THE INVENTION

The invention relates to glazing structures and more particularly but not exclusively to glazing structures for use in curtain walls for the facing or cladding of the outsides of buildings.

SUMMARY OF THE INVENTION

The invention provides a glazing structure comprising an elongated structural member (e.g. a mullion or a transom) having two spaced apart surfaces to abut against, with or without the interposition of gaskets, the one faces of two panel edge portions respectively, a glazing bead of open channel section whereof the channel base is arranged to engage the structural member between the said surfaces with the side walls of the channel extending outwardly away from the structural member, the side walls being turned outwardly from one another at their end portions to provide abutments facing towards the surfaces to lie opposite the other faces of the edge portions of the panels respectively, means (e.g. screws, bolts or nuts) accessible from the outer side of the channel section of the glazing bead to secure the base of the channel of the bead to the structural member and two gaskets of elastomeric material each having a first portion to lie between the abutment and the other faces and second portions to enter within the channel of the glazing bead, the arrangement being such that the glazing bead can first be secured to the structural member with the first portions of the gaskets secured between the bead and the panels to hold the panels in position and the second portions can then be pressed side by side into the channel to form a weatherproof seal for the channel.

The accompanying drawings shows one preferred form of a glazing structure made in accordance with and embodying this invention.

BRIEF DESCRIPTION OF THE DRAWINGS

As shown in FIG. 1 the system comprises the usual vertical structural elements or mullions 1 and horizontal structural elements or transoms 2 and a number of panels glazed into position between the elements. The panels may be of glass or of any other suitable building material such as wood, or the like.

Referring now to FIG. 2 two similar vertical structural elements 1 are shown and only one will be described in detail. Each structural element is of box-section and at the side of the box against which the panels are to be glazed there are provided two flat surfaces 10 and 11 which are spaced apart from one another. A recess 12 is provided between the surfaces 10 and 11 and flanges 13 and 14 project outwardly from the edges of the recess. At the centre of the recess an elongated slot 15 is provided and the sides of the slot are provided with corrugation 16.

Figure 1:
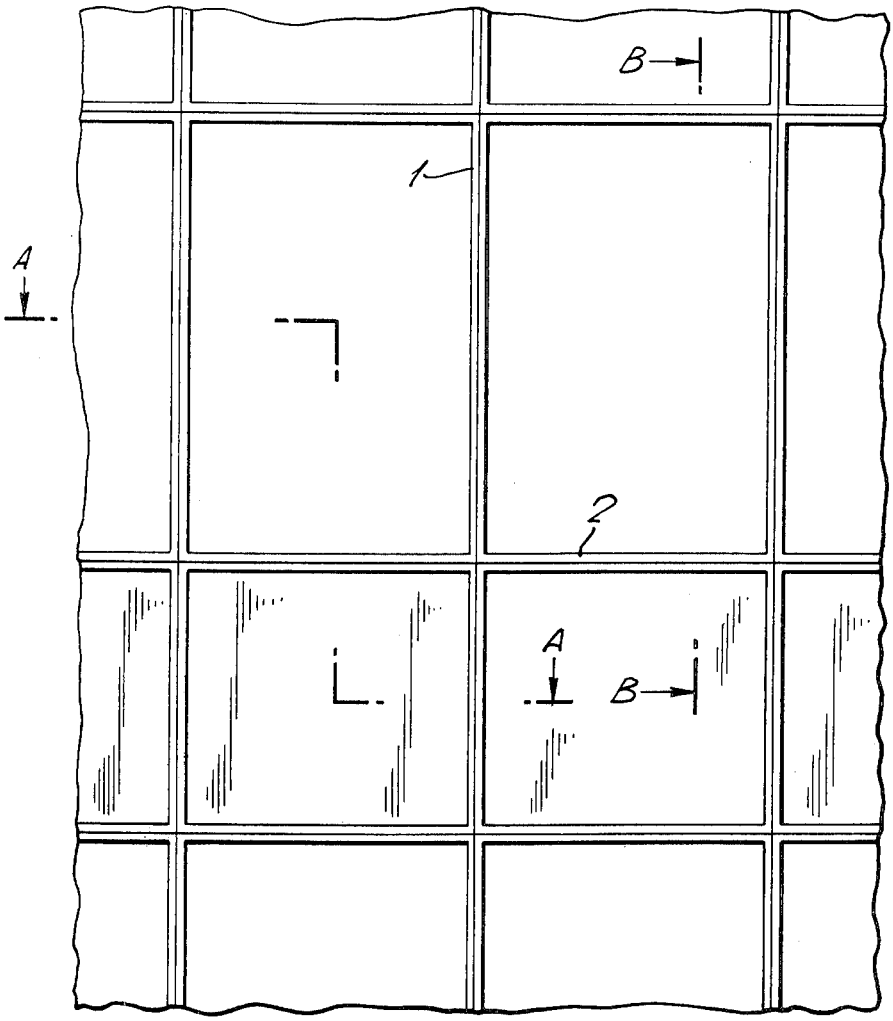
FIG. 1 is part of a typical elevation of a glazing structure.

Self-adhesive expanded PVC backing strips 6 are attached to the surfaces 10 and 11 and the edge portion of two panels 18 and 19 rest on the strips 6.

A glazing bead 4 of aluminium is of channel-shaped cross-section with the side walls of the channel turned outwardly from one another at their end portions 20 and 21. Holes 22 are provided at spaced intervals along the base of the channel-section and screws 23 pass through the holes 22 and make engagement with the corrugations 16 in the slots 15 to retain the bead in position against the structural element 1.

Two neoprene rubber moulded gaskets 5 are provided having first portions 26 which lie between the panels 18, 19 and the end portions 20, 21 of the glazing bead. The gaskets 5 are also provided with second portions 29 and 30 which are pressed inwardly to fill the open mouth of the channel of the glazing bead. Thus the gaskets 5 provide a weatherproof seal for the glazing beads.

Figure 2:
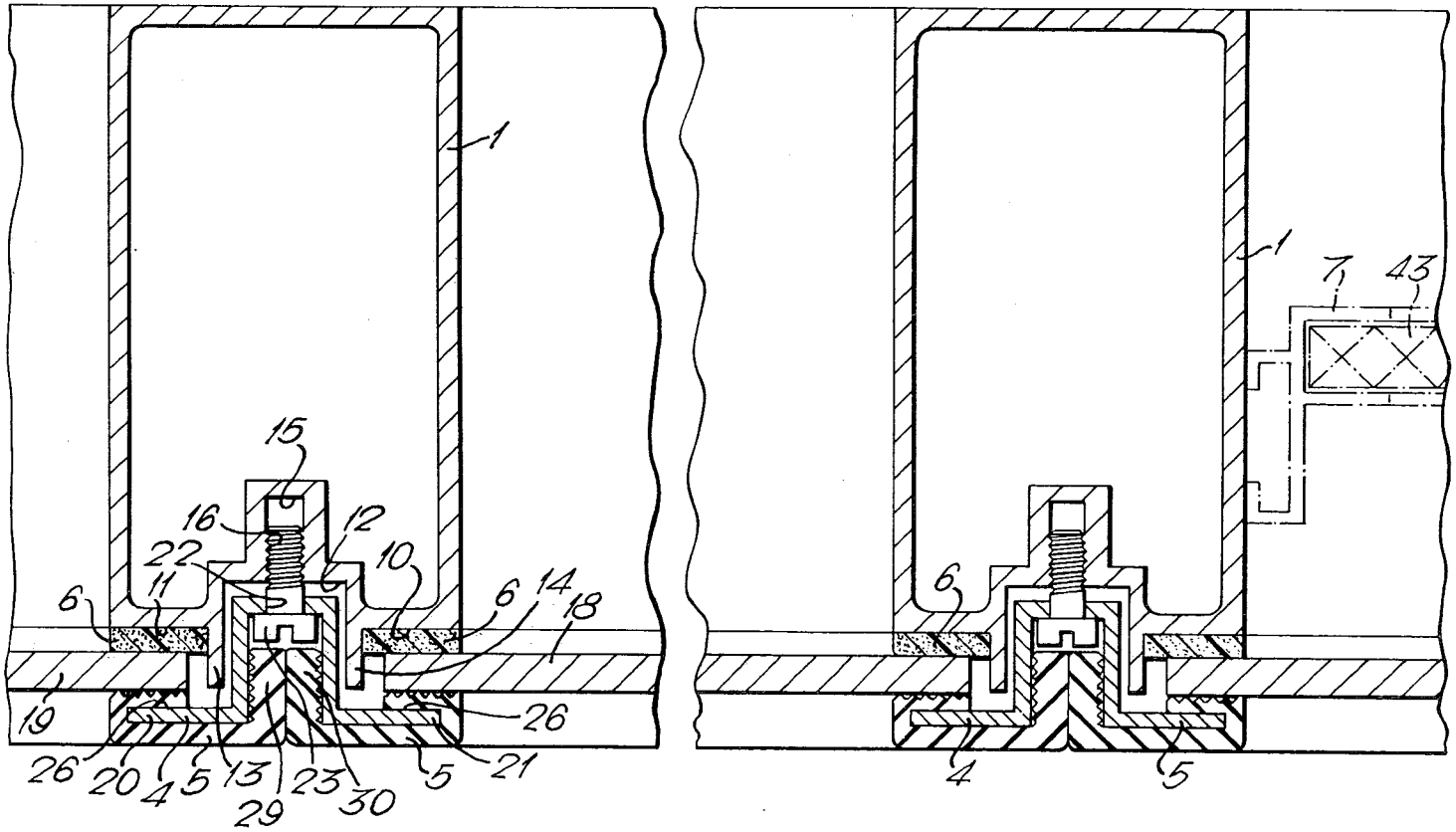
FIG. 2 is a section on the line A-A in FIG. 1.
Figure 3:
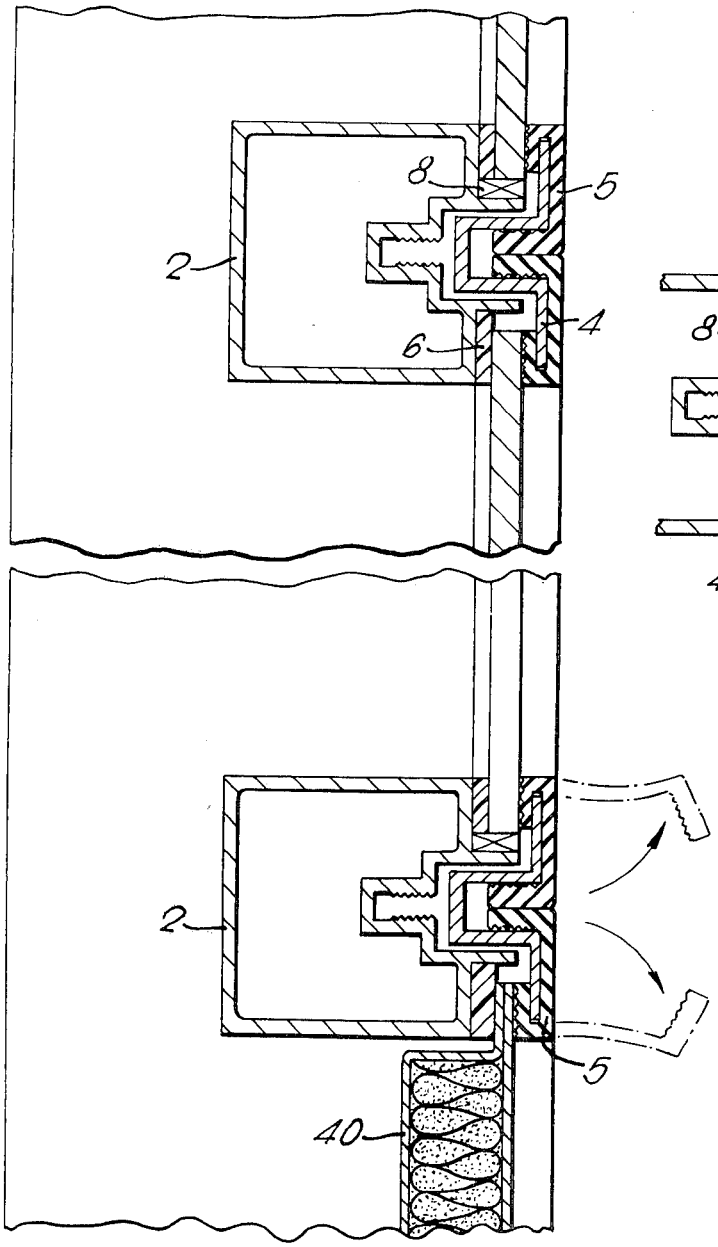
FIG. 3 is a vertical section on the line B-B in FIG. 1.

The arrangement shown in FIG. 3 is similar to that shown in FIG. 2 except that the horizontal elements 2 are of shallower box-section that the elements 1. In addition the panel 40 is of a different construction from the panels 18 and 19 but is in itself a well known building element.

FIG. 3 also indicates with respect to the lower structural element 2 how the structure is assembled. First of all the screw holding the glazing bead to the structural element is tightened to fix the panels and the first portions of the gaskets in position and then finally the second portions of the gaskets are pressed into position.

Figure 4:
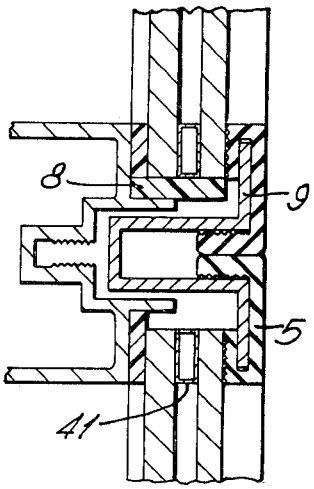
FIG. 4 shows how the arrangement of FIG. 2 or FIG. 3 can be adapted to a double glazing system.

FIG. 4 shows an arrangement for a double glazing system. The only difference here is that the glazing bead 9 is deeper than the bead 4 and the usual spacing members 41 are provided between the two panels. In addition a PVC setting block 8 is provided along the lower edges of the panels.

A further modification is indicated in chain lines in FIG. 2 where fire-break panels 43 may be held in position by brackets 7 which are attached to the structural element 1.

The advantage of the system just described is that the neoprene rubber gaskets completely cover all the external structural aluminium thus providing a completely maintenance free exterior with complete weather tightness. Not only is the external aluminium covered and therefore protected but it is also insulated from the low temperatures ofter recorded outside buildings thus preventing "cold bridging" which is responsible for undesirable condensation on the internal faces of the structural aluminium members.

I claim:

1. A glazing structure comprising an elongated structural member having two spaced apart surfaces to abut against, with or without the interposition of gaskets, the one faces of two panel edge portions respectively, a glazing bead of open channel section whereof the channel base is arranged to engage the structural member between the said surfaces with the side walls of the channel extending outwardly away from the structural member, the side walls being turned outwardly from one another at their end portions to provide abutments facing towards the surfaces to lie opposite the other faces of the edge portions of the panels respectively, means accessible from the outer side of the channel section of the glazing bead to secure the base of the channel of the bead to the structural member and two gaskets of elastomeric material each having a first portion to lie between the abutment and the other faces and second portions to enter within the channel of the glazing bead, the arrangement being such that the glazing bead can first be secured to the structural member with the first portions of the gaskets secured between the bead and the panels to hold the panels in position and the second portions can then be pressed side by side into the channel to form a weatherproof seal for the channel.

2. A glazing structure as claimed in claim 1 having at least fire-break panel held in position parallel to the panels by brackets attached to the structural member.

3. A glazing structure as claimed in claim 1 wherein an additional panel is arranged parallel to and spaced apart from the first panel and where the first portion of each gasket lies between said abutment and the outside face of the additional panel.

* * * * *